US006171144B1

(12) United States Patent
Stone

(10) Patent No.: US 6,171,144 B1
(45) Date of Patent: Jan. 9, 2001

(54) ELECTRICAL CONNECTOR SEALING PLUG

(75) Inventor: Jeffrey A. Stone, Lathrup Village, MI (US)

(73) Assignee: Lear Automotive Dearborn, Inc., South Field, MI (US)

( * ) Notice: Under 35 U.S.C. 154(b), the term of this patent shall be extended for 0 days.

(21) Appl. No.: 09/213,624

(22) Filed: Dec. 18, 1998

(51) Int. Cl.[7] ..... H01R 13/40
(52) U.S. Cl. ..... 439/587
(58) Field of Search ..... 439/587, 589, 439/274, 275

(56) References Cited

U.S. PATENT DOCUMENTS

| | | | | |
|---|---|---|---|---|
| 4,973,268 | * | 11/1990 | Smith | 439/589 |
| 4,993,964 | | 2/1991 | Trummer | 439/272 |
| 5,181,863 | * | 1/1993 | Welsh | 439/275 |
| 5,226,832 | | 7/1993 | Dejardin et al. | 439/274 |
| 5,551,892 | * | 9/1996 | Endo | 439/587 |
| 5,707,251 | * | 1/1998 | Sakai et al. | 439/589 |

FOREIGN PATENT DOCUMENTS 3-74482 * 3/1991 (JP) .

* cited by examiner

*Primary Examiner*—Neil Abrams
(74) *Attorney, Agent, or Firm*—MacMillan, Sobanski & Todd, LLC

(57) ABSTRACT

A sealing plug for a multi-contact electrical connector includes a shaft portion and a locking portion preferably formed of a non-conductive material. The sealing plug is inserted in non-used contact cavities of the multi-contact electrical connector to preclude the necessity of installing separate dummy pin contacts and to effect the environmental sealing of non-used contact cavities. A head portion extends from the shaft portion for gripping purposes and to provide a visual indication that the sealing plug is installed in the connector assembly.

13 Claims, 1 Drawing Sheet

ELECTRICAL CONNECTOR SEALING PLUG

BACKGROUND OF THE INVENTION

The present invention relates to an electrical connector, and more particularly to a sealing plug for a multi-contact electrical connector which precludes the necessity of installing separate dummy pin contacts to effect the environmental sealing of non-used contact cavities.

A multi-pin electrical connector assembly is frequently provided to connect multiple electrical components attached to a wire harness bundle which transmits electrical signals to and from the individual components. In many installations it is unnecessary to use all the pin contacts available in the multi-pin electrical connector as the full capability of the connector is not required in that particular installation. For reasons of standardization, the overly capable multi-pin electrical connector assembly is commonly still provided even though the full capacity of that connector assembly is not required. Dummy circuits having spare pin contacts are therefore included within the wire harness bundle such that the spare pin contacts are inserted in the unused pin contact receiving cavities to environmentally seal the connector.

As shown in FIG. 1, a sectional view of a multi-contact electrical connector assembly 5 includes a connector portion 7 having multiple pin contact receiving cavities 9 and associated pin connector locking members 11. To afford a tight seal with the inserted pin contacts 13, a relatively soft rubber grommet 15 is mounted to the connector portion 7 by a connector cap 17 and includes apertures 19 aligned with the pin contact receiving cavities 9.

Typically, when sealing a non-used pin contact receiving cavity 9 in the connector assembly 5, it is common to insert a spare pin contact 13. The prior art sealing arrangement thus had a spare pin contact 13 attached to a dummy circuit 21 contained within the wiring harness bundle 23. The pin contact 13 is mounted in the pin contact receiving cavity 9 and extends therefrom through the aperture 19 in the grommet 15 to be retained in a conventional manner by a locking member 11. The spare pin contact 13 thereby providing the environmental sealing of any non-used pin contact receiving cavities 9.

While the above-described sealing arrangement was satisfactory for its intended purpose, certain disadvantages were experienced, notably, the use of dummy circuits can not be electrically detected after installation. Additionally, the use of spare pin contacts and dummy circuits prevents the reduction of the wire harness bundle size and increases the cost of the wire harness.

SUMMARY OF THE INVENTION

The present invention provides a sealing plug for a multi-contact electrical connector which environmentally seals non-used contact cavities to thereby alleviate the disadvantages described above.

The sealing plug preferably includes a shaft portion and a locking portion to lock the sealing plug into the electrical connector in a similar manner as a pin contact. The sealing plug extends through the grommet, and is retained by the locking member to effect the environmental sealing of the non-used contact cavities.

The sealing plug is designed to be installed, retained and extracted in the same manner as a pin contact while providing a head portion which extends from the shaft portion for gripping purposes and to provide a visual indication that the sealing plug is installed.

The sealing plug of the present invention therefore results in substantial cost savings by eliminating costly pin contacts, reduces the connector weight, and reduces the overall wire bundle size.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 3:
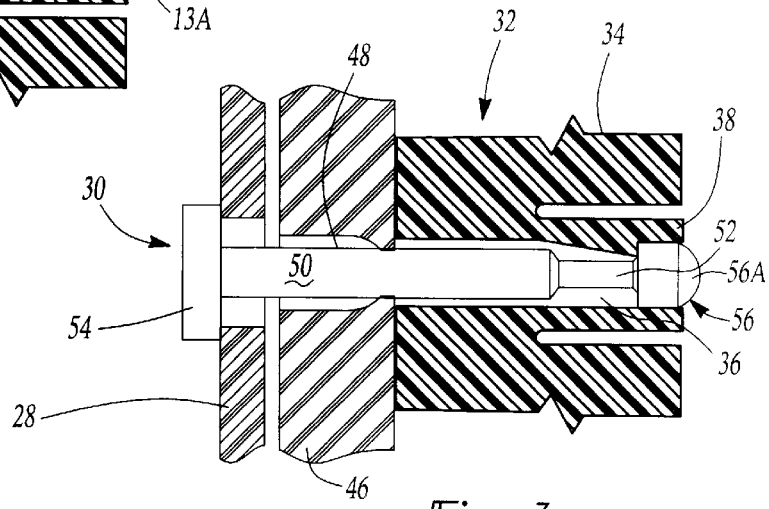
FIG. 3 is an expanded sectional view of one pin contact receiving cavity of the connector shown in FIG. 2 including a sealing plug of the present invention.
Figure 2:
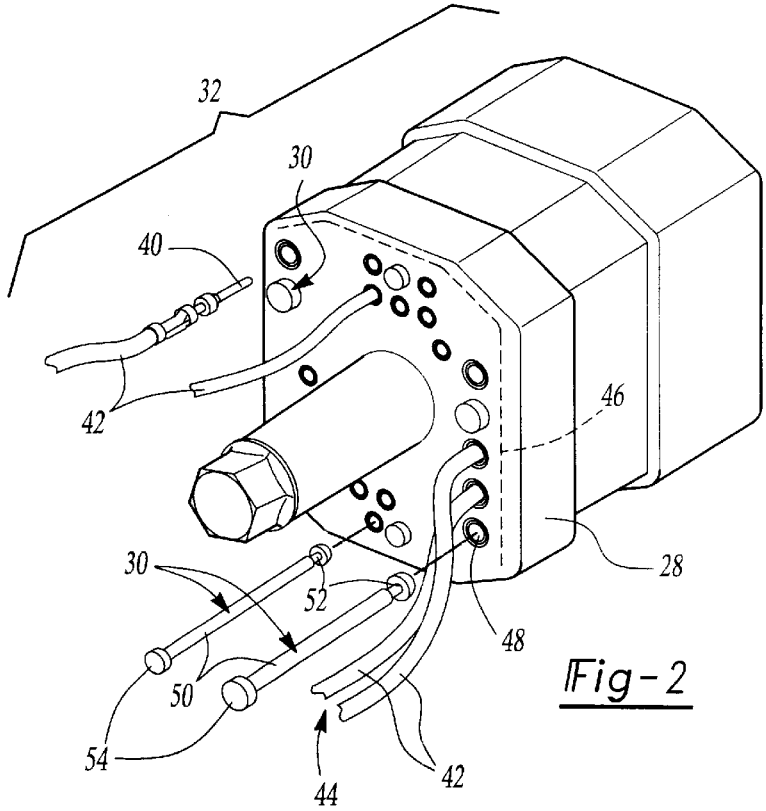
FIG. 2 is a multi-pin electrical connector assembly of the present invention.

FIG. 2 illustrates a sealing plug 30 for use with a multi-pin electrical connector assembly 32 according to the present invention. As shown in FIG. 3, the multi-pin electrical connector assembly 32 of the present invention includes a connector portion 34 having a plurality of pin contact receiving cavities 36. Each pin contact receiving cavity 36 retains the individual pin contacts 40 and thereby assures the electrical connection of the associated circuit 42. The connector portion 34 therefore collectively retains and protects the pin contacts 40 of the individual circuits 42. The individual circuits 42 are collectively held as the wire harness bundle 44 which lead to the associated electrical components (not shown) and the connector portion 34, mates with a related connector portion (not shown) to complete an electrical system of a vehicle or the like.

As shown in FIG. 2, the wires 42 are bundled together at 43 to create a wire harness. To effect the environmental sealing of the connector assembly, a rubber grommet 46 is mounted to an end of the connector portion 34 by a connector cap 28. The grommet 46 is preferably formed of an elastic material which includes apertures 48 aligned with the pin contact receiving cavities 36 of the connector portion 34. The apertures 48 provide for insertion of the pin contacts 40 into the connector portion 34 while sealing each pin contact 40 against the environment.

As shown in FIG. 3, when one of the pin contact receiving cavities 36 is not used, a sealing plug 30 of the present invention is inserted into the unused cavity. The sealing plug 30 extends through the grommet 46, and is retained by the locking member 38 to effect the environmental sealing of the non-used contact cavities 36. The sealing plug 30 is preferably formed of a non-conductive material, such as Valox 325 plastic, manufactured by General Electric Corporation.

The sealing plug 30 preferably includes a head portion 54 which extends from a shaft portion 50 for gripping purposes and to provide a visual indication that the sealing plug 30 is fully installed in the connector assembly 32. The head portion 54 further provides an additional cover to seal the unused pin contact receiving cavity 36.

The shaft portion 50 extends from the head portion 54 for a length which preferably allows the sealing plug 30 to pass through the grommet 46 but not interfere with the electrical contacts of the associated connector portion (not show). The shaft portion 50 is of a diameter which expands the grommet 46 to maintain an effective environmental seal while allowing the sealing plug 30 to be readily extracted. By providing the shaft portion 50 with an equivalent diameter of the largest wire size allowable for the connector portion 34, equivalent sealing is assured.

Figure 1:
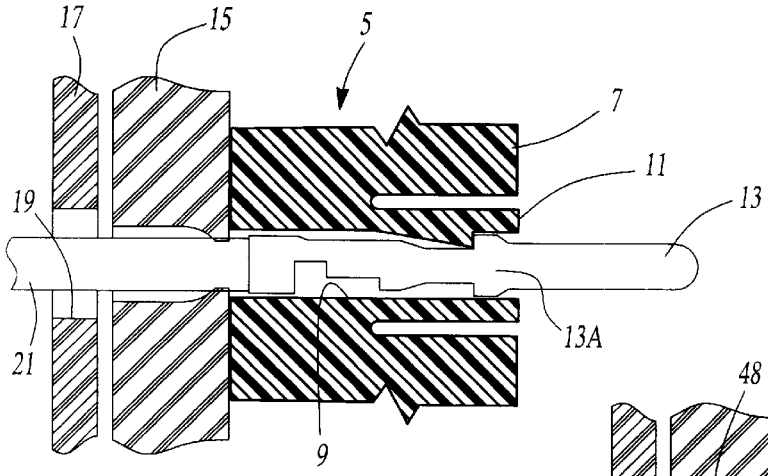
Fig-1 PRIOR ART
FIG. 1 is a sectional view of a pin contact receiving connector employing the prior art sealing arrangement for a non-used pin contact receiving cavity.

The sealing plug 30 further includes a locking portion 52 intermediate the shaft portion 50 and tip portion 56 which is engageable with the locking member 38. The locking portion 52 is preferably configured to have the equivalent shape of a standard pin contact. The locking portion 52 therefore provides an area of reduced diameter which engages the locking member 38 of the pin contact receiving cavity 36 in an equivalent fashion as the pin contact 13 (FIG. 1). A ramp area 52a is preferably adjacent the locking portion 52 and shaft portion 50 to prevent damage to the grommet 46 during plug 30 insertion and to strengthen the locking portion 52.

The tip portion 56 is configured to be of an equivalent shape of a standard pin contact 13 to lock the sealing plug 30 as the standard pin contact lock 13a (FIG. 1). The tip portion 56 preferably includes a semi-sphelical end 56a to further prevent damage to the grommet 46 during plug 30 insertion. Additionally, the tip portion 56, is shorter than a standard pin contact 13 such that the sealing plug does not interfere with the electrical contacts of the associated connector portion (not show). The sealing plug 30 is therefore preferably installed, retained, and extracted in the same manner as a pin contact.

With the prior art, a worker electrically testing the wire harness would be unable to detect the dummy contacts by continuity testing. This is because the dummy contacts would visually resemble the true electrical contacts and the dummy ends of the circuit are non-conductive. As such, the dummy contacts are difficult to determine with the prior art. Since the present invention provides sealing plugs which are shorter and nonconductive, the dummy areas will be visually detectable and their presence can therefore be detected electronically by interference sensors.

The present invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. An electrical connector assembly, comprising:

a connector portion having a plurality of pin contact receiving cavities, each of said pin contact receiving cavities having an associated locking member;

a rubber grommet mounted to an end of said connector portion, said grommet having apertures aligned with said pin contact receiving cavities; and a sealing plug inserted within at least one of said pin cavities, said sealing plug having a shaft portion and a locking portion, said shaft portion extending through said grommet, and said locking portion engageable with said locking member to maintain said sealing plug within said pin contact receiving cavity, said locking portion including an area of reduced diameter when compared to the shaft portion, the area of reduced diameter terminating in a tip portion having a diameter sufficient to engage said locking member.

2. The electrical connector according to claim 1, including a ramp area formed between said shaft portion and said locking portion to prevent damage to said rubber grommet and to strength said locking portion.

3. The electrical connector according to claim 1, wherein said sealing plug has a head portion extending from said shaft portion providing a visual indication that said sealing plug is inserted within said pin contact receiving cavity and to cover any unused pin contact receiving cavity.

4. The electrical connector according to claim 1, wherein said tip portion includes a semi-spherical end to prevent damage to said grommet.

5. The electrical connector according to claim 1, wherein said sealing plug has a shortened tip portion as compared to pin contacts inserted into openings of said pin contact receiving cavities such that said sealing plug does not interfere with an electrical contact of an associated connector portion.

6. An electrical connector assembly, comprising:

a connector portion having a plurality of pin contact receiving cavities, each of said pin contact receiving cavities having an associated locking member;

a rubber grommet mounted to an end of said connector portion, said grommet having apertures aligned with said pin contact receiving cavities; and a non-conductive sealing plug insertable within a pin contact receiving cavity, said sealing plug having a shaft portion, a locking portion, and a head portion extending from said shaft portion, said shaft portion extending through said grommet, and said locking portion engageable with said locking member to maintain said sealing plug within said pin contact receiving cavity, said locking portion including an area of reduced diameter when compared to the shaft portion, the area of reduced diameter terminating in a tip portion having a diameter sufficient to engage said locking member, and said head portion extending from said rubber grommet to provide a visual indication that said scaling plug is inserted within said pin contact receiving cavity.

7. The electrical connector according to claim 6, including a ramp area formed between said shaft portion and said locking portion to prevent damage to said rubber grommet a nd to strength said locking portion.

8. The electrical connector according to claim 7, wherein said tip portion includes a semi-spherical end to prevent damage to said grommet.

9. The electrical connector according to claim 7, wherein said sealing plug has a shortened tip portion such that said sealing plug does not interfere with an electrical contact of an associated connector portion.

10. A wire harness assembly, comprising:

a bundle of wires;

an electrical connector assembly attached to said wires, said connector assembly having:

a connector portion having a plurality of pin contact receiving cavities, each of said pin contact receiving cavities having an associated locking member;

a grommet mounted to an end of said connector portion, said grommet having apertures aligned with said pin contact receiving cavities; and a sealing plug insertable within a pin contact receiving cavity, said sealing plug having a shaft portion, a locking portion, and a tip portion, said shaft portion extending through said grommet, said locking portion engageable with said locking member to maintain said sealing plug within said pin contact receiving cavity such that said tip portion does not interfere with an electrical contact of an associated connector portion, said locking portion including an area of reduced diameter when compared to the shaft portion the area of reduced diameter terminating in said tip portion having a diameter sufficient to engage said locking member.

11. The electrical connector according to claim 10, including a ramp area formed between said shaft portion and said locking portion to prevent damage to said rubber grommet and to strength said locking portion.

12. The electrical connector according to claim 10, wherein said tip portion includes a semispherical end.

13. The electrical connector according to claim 10, wherein said sealing plug has a head portion extending from said shaft portion providing a visual indication that said sealing plug is inserted within said pin contact receiving cavity.

* * * * *